US005092426A

United States Patent [19]

Rhodes

[11] Patent Number: 5,092,426

[45] Date of Patent: Mar. 3, 1992

[54] SAFETY DEVICE AND SYSTEM

[76] Inventor: C. Anthony Rhodes, 1947 Capri Dr., Charleston, S.C. 29407

[21] Appl. No.: 539,580

[22] Filed: Jun. 18, 1990

[51] Int. Cl.[5] ..... A62B 35/00

[52] U.S. Cl. ..... 182/3; 248/231.4; 269/228

[58] Field of Search ..... 182/3, 5–9; 269/228; 248/231.4, 231.6, 316.4

[56] References Cited

U.S. PATENT DOCUMENTS

| | | | |
|---|---|---|---|
| 140,136 | 6/1873 | Holt | 269/228 |
| 2,179,173 | 11/1939 | Boomgarden . | |
| 2,650,787 | 9/1953 | Valentine | 248/231.4 |
| 3,137,487 | 6/1964 | Lesser . | |
| 3,217,833 | 11/1965 | Smith . | |
| 3,938,619 | 2/1976 | Kurabayashi . | |
| 4,052,028 | 10/1977 | Cordero, Jr. . | |
| 4,188,023 | 2/1980 | Whaley | 269/228 |
| 4,499,966 | 2/1985 | Milne et al. . | |
| 4,542,804 | 9/1985 | Power . | |
| 4,852,692 | 8/1989 | Flaherty | 182/5 |
| 4,928,790 | 5/1990 | Franks | 182/3 |

*Primary Examiner*—Reinaldo P. Machado

[57] ABSTRACT

First and second elongated members are slidable along each other to form a beam of variable length to span the top surface of a structure on which a worker is positioned. Clamping surfaces extend from the ends of the beam to engage the sides of the structure. A lever pivotally mounted on the first elongated member is connected through a link to the second elongated member to shorten the beam and urge the clamping surfaces against the structure. A worker's safety line may be attached to the device such that the lever is locked relative to the first elongated member to secure the device to the structure whenever the safety line is attached.

19 Claims, 4 Drawing Sheets

SAFETY DEVICE AND SYSTEM

BACKGROUND OF THE INVENTION

The present invention relates to a safety device for protecting a worker from a dangerous fall from a structure on which he is positioned. More particularly, this invention is directed to a safety system suitable for protecting a worker positioned on a large shipping container or similar structure of a uniform dimension. Generally, such containers are 20 or 40 feet in length, as used on ships and as carried on semi-trailers.

In the handling of shipping containers, particularly during discharge and loading, it is necessary for at least one worker to be positioned on top of a container or tier of stacked containers, performing tasks at the corners or edges of the container. Because of rain, wind or other unanticipated occurrences, as well as the possible carelessness of the worker or his co-workers, there is a risk of a dangerous fall. It is therefore highly desirable to provide safety means to protect the worker and, secondarily, to allow the worker to perform his tasks more efficiently and to lower the cost of occupational insurance.

Generally, a worker cannot be provided with a harness and safety line to prevent or arrest a fall from the container on which he is positioned because the container has no adequate tie off for a safety line. Various safety devices have been proposed to secure a safety line to the flanges of a structural beam for use by steelworkers. However, because a shipping container does not have flanged structural beams, such devices are not suitable to protect a worker positioned on top of a container. Further, because the tie off should be away from the edge of the container, such devices would not be suitable even if the perimeter of the container included a flanged beam.

Other devices have been proposed to suspend a worker or a platform from a building. For example, it has been suggested that a worker could be supported in a bosun chair suspended from a support adapted for rolling along the top edge of an exterior wall of a building, such as might be useful for a worker washing the windows of the building. And, it has been suggested that a scaffold may be suspended from a roof by means of a clamp applied to the eaves of a building, as might be useful for painters of the sides of the building. However, such devices would not be suitable for a worker positioned on top of a shipping container.

Accordingly, an object of the present invention is to provide a convenient mounting device for securing a safety line to a shipping container, or similar structure, so as to protect a worker positioned on the container or structure.

It is a further object of the present invention to provide a safety system for a worker positioned on top of a shipping container, or similar structure, for preventing or arresting a fall from the container or structure.

SUMMARY OF THE INVENTION

The present invention is directed to a novel mounting device for securing a safety line to a structure on which a worker is positioned, as well as to a fall arresting system for the worker.

According to one aspect of the invention, first and second elongated members are positioned on a common axis and are slidable along each other to form a beam of variable length spanning the structure on which the worker is positioned. Clamping surfaces extend from the ends of the beam to engage the sides of the structure. A lever pivotally mounted on the first elongated member is releasably connected to the second elongated member through a link such that pivoting the lever shortens the beam and urges the clamping surfaces against the structure to secure the mounting device.

The mounting device of the present invention provides a lightweight, portable anchor that is particularly well suited for securing a worker's safety line to a shipping container. The first elongated member may be of tubular configuration, permitting the second elongated member to telescope into the first for ease in carrying and storage. The lever action of the mounting device ensures that the beam is shortened to a pre-set length and that proper tension is applied to the clamping surfaces each time the mounting device is clamped onto a shipping container or other structure of a uniform dimension.

Preferably, a safety line is secured to the mounting device such that the lever is locked relative to the first elongated member after the clamping surfaces have been urged against the structure. For example, a hook on the end of the safety line may be used to pin the lever to an apertured extension of the first elongated member. In this way, the separate steps of locking the lever in place and attaching the safety line are combined into one step. In addition, whenever the safety line is hooked to the mounting device, the mounting device is safely locked against the structure on which the worker is positioned.

An improved fall arresting system is also provided according to this invention. In addition to the mounting device just described, the invention provides a safety line and harness that enable a worker to safely work on a shipping container or other structure without risk of a dangerous fall. Preferably, an inertial reel pays out additional safety line as needed but arrests the worker if he falls. Alternatively, the safety line may be of a length sufficient to permit the worker to do his tasks but insufficient to permit a fall from the structure on which he is working.

The invention, together with further objects and attendant advantages, will be best understood by reference to the following detailed description of the preferred embodiments taken in conjunction with the accompanying drawings.

DETAILED DESCRIPTION OF A PREFERRED EMBODIMENT

Figure 1:
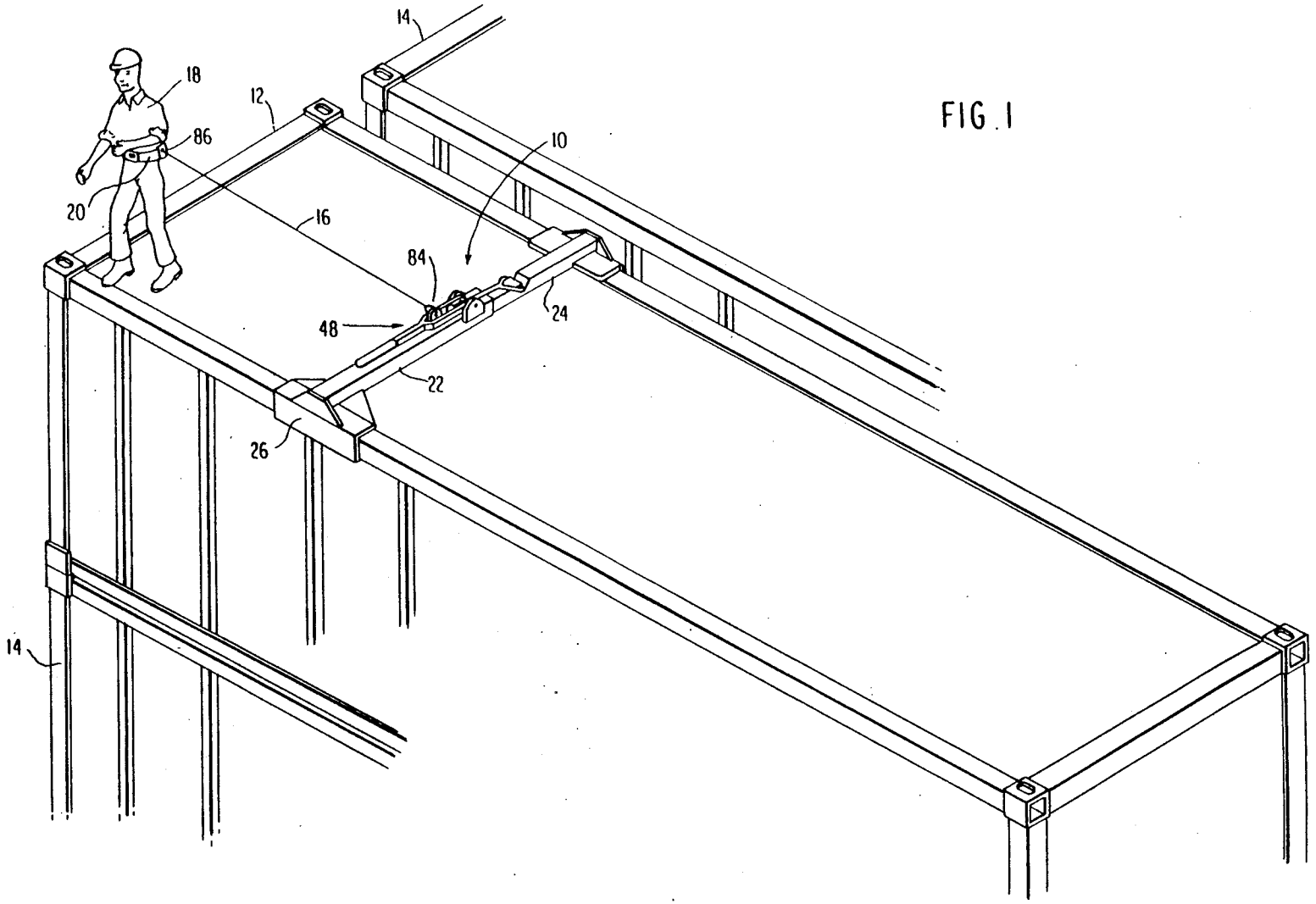
FIG. 1 is a perspective view of a fall arresting system of the present invention operatively connected to a shipping container and a workman.
Figure 2:
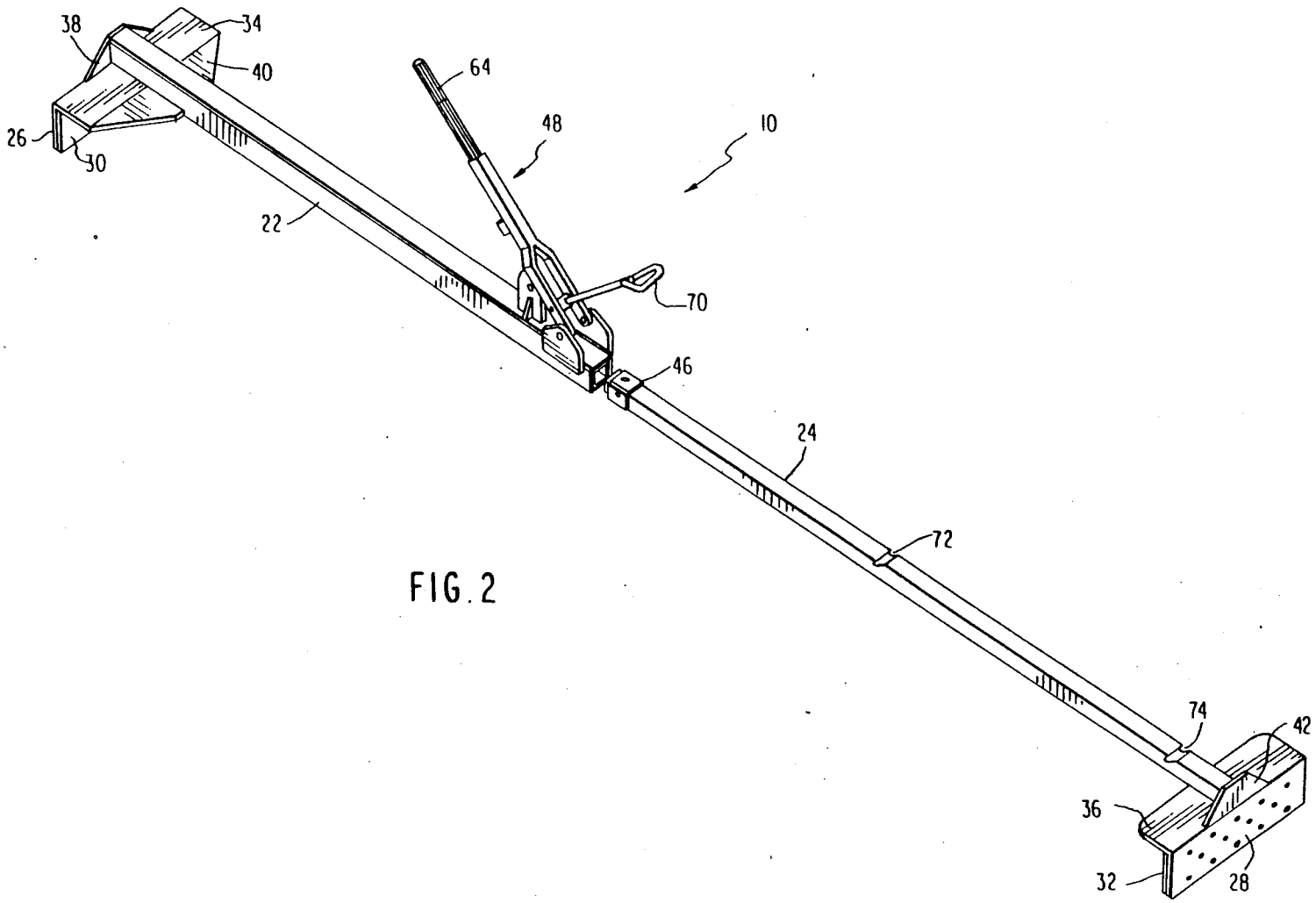
FIG. 2 is an exploded perspective view of the mounting device included in the fall arresting system of FIG. 1.
Figure 3:
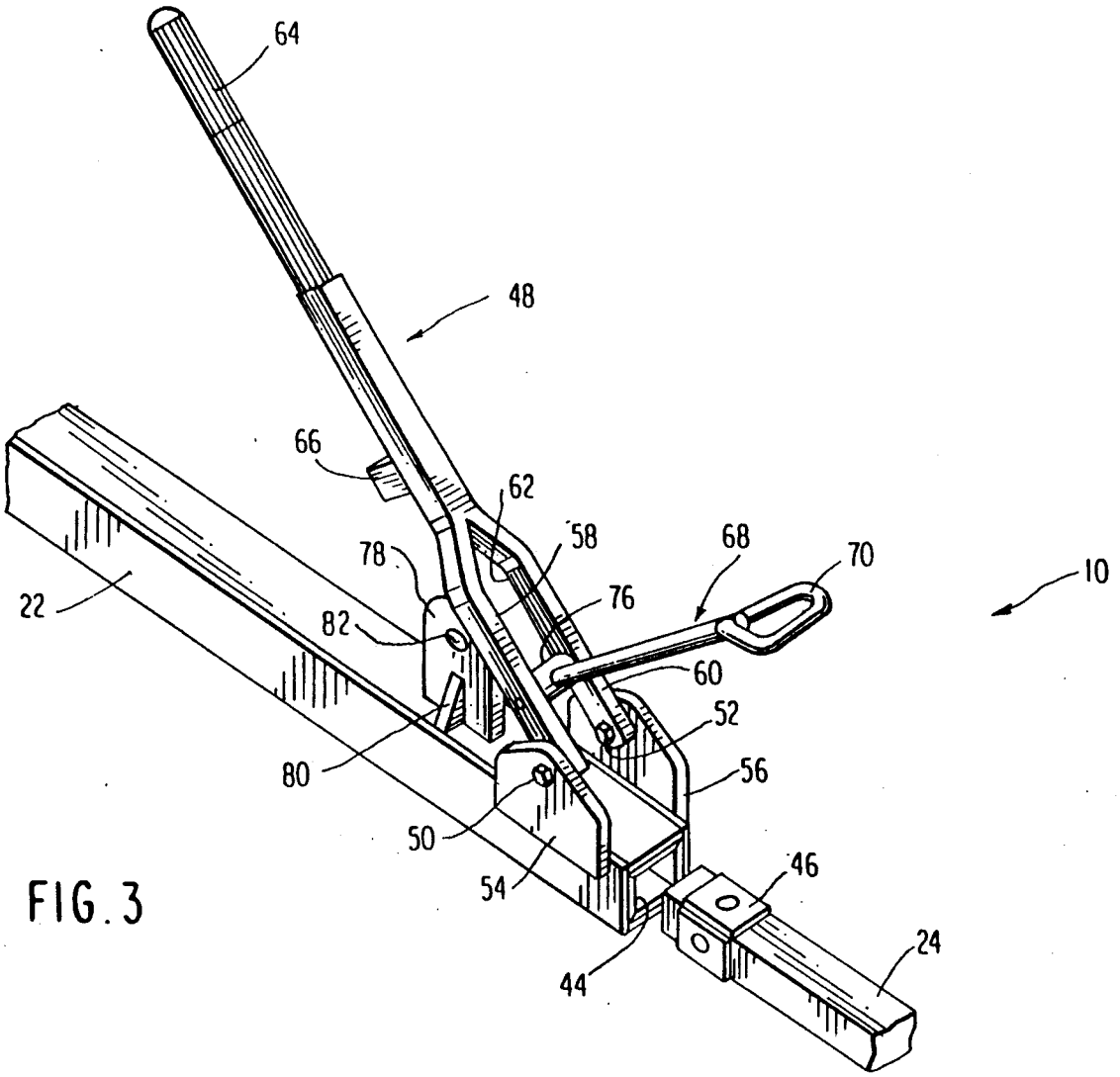
FIG. 3 is an enlarged view of a portion of FIG. 2.

With reference to the drawings, a preferred embodiment of a fall arrest system for a worker positioned on top of a shipping container or similar structure is shown in FIG. 1. The system includes a mounting device, indicated generally by the numeral 10, fixed to the upper edges of a shipping container 12, that may be stacked on top of one or more other shipping containers 14 to form a tier. A safety line 16 is secured to a worker 18 by a harness 20 to limit the distance of the worker 18 from the mounting device 10.

The mounting device 10 includes a first elongated member 22, configured as a square tube, and a second elongated member 24, aligned along the same axis, that is slidably movable within the second elongated member 22. Together the elongated members 22 and 24 form a telescoping beam of variable length for spanning the top of the container 12.

Clamping members 26 and 28 extend downward from the distal ends of the elongated members 22 and 24 to engage the upper edges of the container 12. Resilient pads 30 and 32, of rubber or another suitable material, are mounted on the clamping members 26 and 28 to facilitate the frictional grip of the clamping members against the container 12. Horizontal members 34 and 36, fixed to the elongated members and the clamping members strengthen the clamping surfaces and contact the top surface of the container 12 to prevent twisting or rotating of the mounting device 10 relative to the container 12. Additional plates 38, 40 and 42 may be used to provide further strength.

To facilitate smooth sliding movement of the second elongated member 24 Within the first elongated member 22, glide strips 44 and 46 are fixed to the ends of the elongated members opposite the clamping members 26 and 28. The glide strips 44 and 46 may be plates of a suitable plastic, having a low coefficient of friction, fixed to the elongated members by recessed screws or other means. In addition to enhancing sliding, the glide strips 44 and 46 serve as stops to prevent the elongated member 24 from separating from the elongated member 22.

A lever, indicated generally by the numeral 48, is pivotally mounted on the first elongated member 22 by bolts 50 and 52 that are journaled in pivot members 54 and 56, welded or otherwise fixed to the elongated member. The lever 48 is forked into two legs 58 and 60 at the end mounted on the first elongated member 22, thereby providing an aperture 62, and has a handle 64 at the opposite end. A stop member 66 may be fixed to the lower surface of the lever 48 to prevent the handle 6 from moving tightly against the first elongated member 22.

A link, indicated generally by the numeral 68, is journaled within the aperture 62 of the lever 48 at one end and has a stirrup 70 at the opposite end for engagement with at least one recess 72 in the second elongated member 24. Additional recesses 74 may be formed in the member 24 to provide various pre-set lengths of the mounting device 10 and to lock the mounting device 10 in a compact configuration for carrying. Preferably, the effective length of the link 68 is selectively adjustable. In the embodiment shown, adjustment is provided by threading the end of the link 68 opposite the stirrup 70 into a tapped cylindrical bushing 76 journaled in holes in the legs 58 and 60.

The lever action just described provides increased force on the recess 72 as the lever 48 approaches the first elongated member 22, given a uniform torque applied to the handle 64. By selecting the alignment of the bolts 50 and 52 with respect to the bushing 76 and the recess 72, and also the height of the stop member 66, the amount of clamping force applied to the edges of the container 12 can be carefully controlled. Further, that alignment can be selected to provide a neutral or "over-center" locking effect by allowing the lever 48 to pivot the bushing 76 below a plane formed by the bolts 50 and 52 and the recess 72.

In the embodiment shown, the lever 48 is cut and machined from aluminum stock to reduce weight, and the link 68 is bent and machined from stainless steel rod, to provide corrosion resistance. However, other materials may be used with similar effect. Similarly, the configurations of the lever 48 and the link 68 may vary considerably. For example, the lever 48 may have a single end instead of legs 58 and 60 and may be pivoted on a single axle instead of bolts 50 and 52. In such case, the link 68 could be pivotably mounted on side portions of the lever 48 instead of within an opening between legs 58 and 60.

Figure 4:
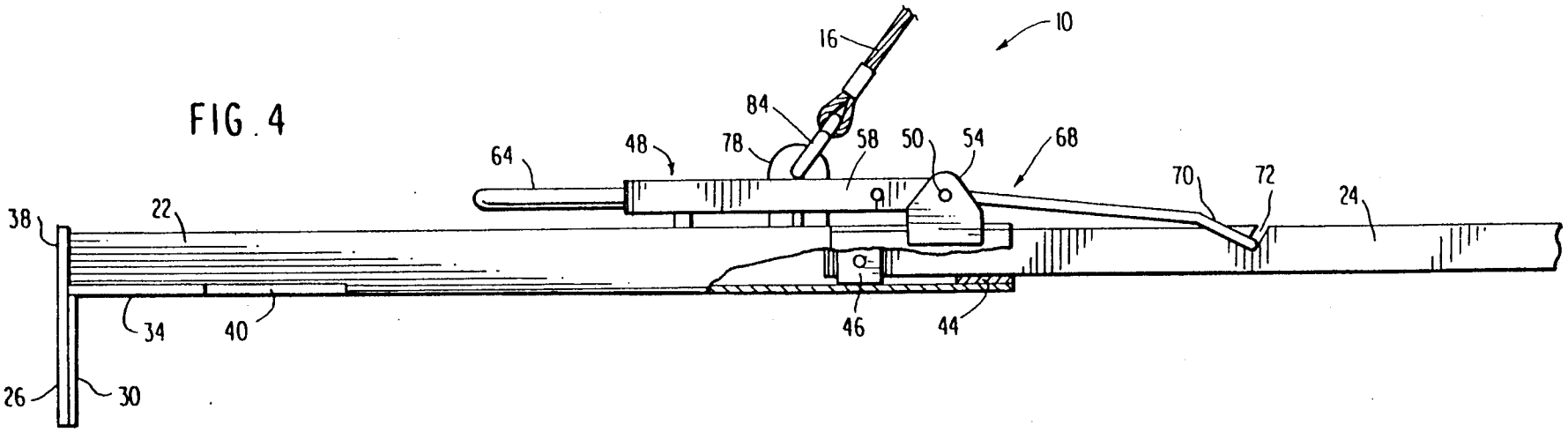
FIG. 4 is an elevational view of the mounting device of FIGS. 1 and 2, with portions cut away, operatively connected to a safety line.

A vertical member 78, supported by gussets 80, extends upward from the first elongated member 22 such that it protrudes through the aperture 62 of the lever 48 when the stop member 66 of lever 48 is moved against the elongated member 22. The protruding portion of the vertical member 78 has a hole 82 for receiving a hook 84, as shown in FIG. 4, or other pin means to limit movement of the lever 48 away from the first elongated member 22. Although other types of hooks may be used with similar effect, the hook 84 may be a snap shackle as used on a boat or a hook similar to a carabiner used by a mountain climber.

Generally, the hook 84 is the termination of the safety line 16 secured to the worker 18 by the harness 20. Because the worker generally has tasks at the corners of the container 12, there may be an advantage of locating the hole 82 of the vertical member 78 near a midpoint of the mounting device 10 when the mounting device is clamped to the container 12. To effect this location, the lengths of the first and second elongated members may be approximately one-half the width of the container plus the additional length required for the pivot members 54 and 56 and the vertical member 78.

Preferably, the safety line 16 is connected through an inertial reel 22 that can be mounted on the harness 20, as shown in FIG. 1. The inertial reel may also be mounted on the hook 84, or in another convenient location. The inertial reel 86 pays out line to permit the worker 18 to perform his tasks unrestrictedly and reels up unneeded line when the worker moves to a position closer to the mounting device 10. If the worker slips or falls, causing a jerking of the line, the inertial reel immediately stops the paying out of line to arrest the worker's fall. The inertial reel 86 is of a standard type similar to that used with retracting automobile seatbelts.

Alternatively, the inertial reel 86 may be eliminated and the safety line 16 selected sufficiently long to permit the worker 18 to perform his tasks but short enough to prevent the worker from falling over the edge of the container 12. In such case, the mounting device 10, the safety line 16, and the harness 20 provide a fall prevention system instead of a fall arresting system.

Although other constructions may be used, the first elongated member 22 may be a weldment of aluminum plates or a preformed aluminum tube, and the second elongated member 24 may be a square bar of aluminum. The clamping members 26 and 28, the horizontal members 34 and 36, the additional plates 38, 40 and 42, the pivot members 54 and 56, the vertical member 78 and the gussets 80 may be made of aluminum plates and welded to the elongated members 22 and 24. Such construction is lightweight and permits the mounting device 10 to be easily carried by a single worker.

OPERATION OF THE PREFERRED EMBODIMENT

Figure 5:
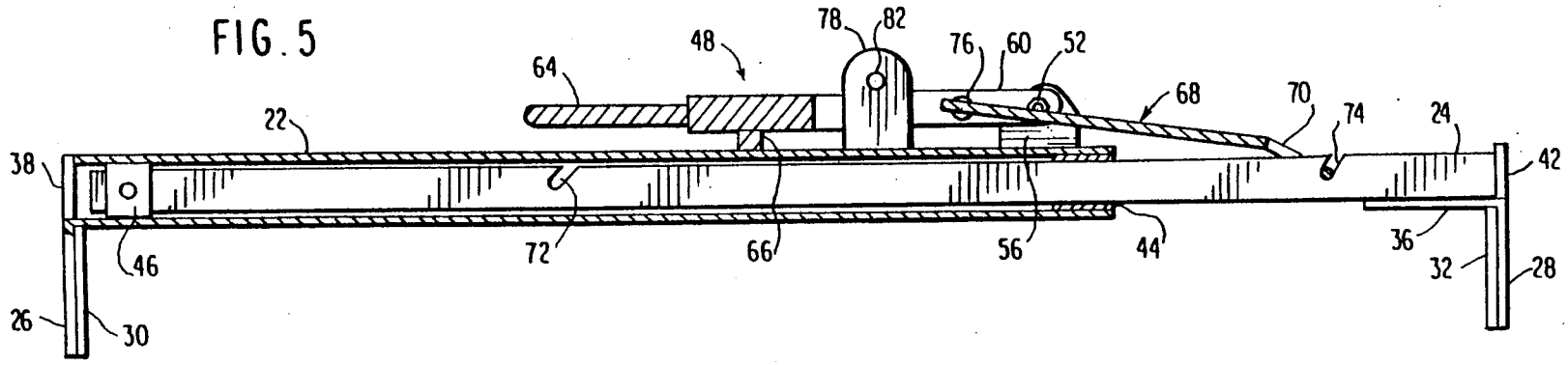
FIG. 5 is a sectional elevational view of the mounting device of FIGS. 1 and 2, telescoped to a compact carrying configuration.

In operation, the worker 18 carries the mounting device 10 to an appropriate location on top of the container 12. For convenience, the mounting device 10 may be secured in the carrying and storage configuration shown in FIG. 5 by inserting a pin, not shown, in the hole 82. The worker then retracts the pin (if used) and spreads the elongated members 22 and 24 to span the width of the top of the container 12, as shown in FIG. 1. Typically, the container 12 will have a standard width of 10 feet.

The worker 18 then positions the stirrup 70 of the link 68 in the recess 72 corresponding to the standard width of the container 12 and pivots the lever 48 by manipulating the handle 64 toward the clamping member 26 until the stop member 66 is against the first elongated member 22. This action pulls the second elongated member 24 into the first elongated member 22 and compresses the resilient pads 30 and 32 against the edges of the container 12 to frictionally hold the mounting device in place. The worker 18 may vary the length of the link 68 by threading it into or out of the bushing 76 to provide a pre-set fine adjustment of the force applied by the clamping members 26 and 28.

The worker 18 then secures the safety line 16 to the mounting device 10 by inserting the hook 84 of the safety line 16 into the hole 82 in the portion of the vertical member 78 protruding through the lever 48. The hook 84 is of sufficient size to prevent the lever 48 from releasing the clamping force on the container 12 as long as the worker 18 is connected to the mounting device 10 by the safety line 16. Thus, the act of hooking onto the mounting device 10 eliminates any need for an additional step of to lock the mounting device against inadvertent release.

After the worker 18 completes his tasks, he returns to the mounting device 10 and unhooks the safety line 16 from the mounting device by removing the hook 84 from the hole 82. This releases the lever 48 and permits the worker to pivot the handle 64 and lift the stirrup 70 from the recess 72. The worker 18 can then slide the mounting device 10 to a different position on the container 12 or can lift one of the clamping members 26 and 28 above the edge of the container 12 and telescope the second elongated member 24 into the first elongated member 22 to facilitate carrying the mounting device to another container or to storage.

Although it is preferred that the safety line 16 is connected to the mounting device 10 such that the mounting device 10 is locked in clamping position as a single step, more conventional connecting means may be employed. Thus, vertical member 78 may be replaced by different locking means and the safety line 16 may be tied off to the mounting device by a locking means other than that of vertical member 78. For example, the "over-center" locking configuration described above could serve as a locking device, eliminating the need for a separate locking member, and the safety line 16 could be tied to the first elongated member 2 by a simple knot.

From the foregoing, it should be apparent that a novel mounting device suitable for securing a safety line to a shipping container or similar structure on which a worker is positioned has been disclosed. The mounting device is lightweight and is conveniently portable. The lever action of the mounting device provides predictable and repeatable force on the edges of the container or other structure to frictionally secure the mounting device. The hook of the safety line serves as a locking means to prevent inadvertent releasing of the mounting device. Together with the safety line and harness, the mounting device provides an effective and convenient fall arresting system.

Of course, it should be understood that various changes and modifications to the preferred embodiment described above will be apparent to those skilled in the art. Additionally, various embodiments of the present invention may be adapted for specific sizes and shapes of structures on which a worker may be positioned to perform a task. The present invention is not intended to be limited to use only with shipping containers. It is therefore intended that the foregoing detailed description be regarded as illustrative rather than limiting and that it be understood that it is the following claims, including all equivalents, that are intended to define the scope of this invention.

I claim:

1. A mounting device for securing a safety line to a structure on which a worker is positioned, comprising:

a first elongated member;

a second elongated member, substantially coaxial with the first elongated member, having a side portion thereof slidably movable along a side portion of the first elongated member such that the elongated members together span the structure on which the worker is positioned;

clamping means mounted on the distal ends of the first and second elongated members adapted for engaging the structure;

a lever pivotally mounted on the first elongated member;

linking means pivotally mounted on the lever and releasably engagable with the second elongated member such that pivoting the lever causes the second elongated member to slide along the first elongated member and causes the clamping means to engage the structure and secure the mounting device to the structure; and connecting means on the first elongated member adapted for connecting a safety line to which the worker may be secured.

2. The mounting device of claim 1 wherein the connecting means cooperates with the safety, line to limit movement of the lever relative to the first elongated member when the safety line is secured to the mounting device so as to lock the mounting device against the structure.

3. The mounting device of claim 2 wherein the connecting means comprises a vertical member adapted for releasably mounting the safety line.

4. The mounting device of claim 3 wherein the lever has an aperture such that the vertical member protrudes through the lever when the mounting device is secured to the structure.

5. The mounting device of claim 4 wherein the vertical member has an aperture for receiving a hook of the safety line such that the hook prevents the lever from pivoting away from the first elongated member.

6. The mounting device of claim 1 wherein the first elongated member is tubular and the second elongated member telescopes within the first elongated member to form a beam of variable length adapted to span the structure on which the worker is positioned.

7. The mounting device of claim 1 wherein each clamping means has a substantially flat portion extending downward from the first and second elongated members for engagement with side portions of the structure on which the worker is positioned.

8. The mounting device of claim 7 wherein the flat portion of each clamping means has a resilient surface for frictionally engaging side portions of the structure on which the worker is positioned.

9. The mounting device of claim 1 further comprising substantially horizontal surfaces extending outward from the first and second elongated members adapted for engagement with an upper surface of the structure on which the worker is positioned to prevent twisting of the mounting device relative to the structure.

10. The mounting device of claim 1 wherein the linking means is a rigid link adapted for releasable engagement with the second elongated member.

11. The mounting device of claim 10 wherein the second elongated member has at least one recess into which the rigid link may be positioned to effect the releasable engagement with the second elongated member.

12. The mounting device of claim 10 wherein the rigid link is threadably connected to the first elongated member such that the effective length of the linking means is selectively variable.

13. A fall arresting system for a worker positioned on a structure, comprising:

a first elongated member;

a second elongated member, substantially coaxial with the first elongated member, having a side portion thereof slidably movable along a side portion of the first elongated member such that the elongated members together span the structure on which the worker is positioned;

clamping means mounted on the distal ends of the first and second elongated members adapted for engaging the structure;

a lever pivotally mounted on the first elongated member;

linking means pivotally mounted on the lever and releasably engagable with the second elongated member such that pivoting the lever causes the second elongated member to slide along the first elongated member and causes the clamping means to engage the structure;

a safety line;

connecting means on the first elongated member releasably connecting the safety line to the first elongated member; and a harness connected to the safety line and adapted for securing the safety line to the worker.

14. The fall arresting system of claim 13 wherein the safety line has an inertial reel to permit the worker to move freely over the surface of the structure on which he is positioned and to arrest the worker during a fall from the structure.

15. The fall arresting system of claim 13 wherein the safety line is long enough to permit the worker to perform his tasks but is short enough to prevent the worker from falling from the structure.

16. The fall arresting system of claim 13 wherein the connecting means cooperates with the safety line to limit movement of the lever relative to the first elongated member when the safety line is connected to the connecting means so as to lock the clamping means against the structure.

17. The fall arresting system of claim 16 wherein the connecting means comprises a vertical member and wherein the lever has an aperture through which the vertical member protrudes when the lever is pivoted to move the clamping means into engagement with the structure.

18. A mounting device for securing a safety line to a shipping container on which a worker is positioned, comprising:

a tubular first elongated member;

a second elongated member, axially movable within a portion of the first elongated member such that the elongated members together form a telescopic beam spanning the container on which the worker is positioned;

clamping means mounted on the distal ends of the telescoping beam adapted for engaging opposing edges of the top of the container;

a lever pivotally mounted on the first elongated member;

linking means pivotally mounted on the lever and releasably engagable with the second elongated member such that pivoting the lever causes the second elongated member to telescope further into the first elongated member and causes the clamping means to engage the edges of the top of the container and secure the mounting device to the container; and connecting means on the first elongated member adapted for connecting a safety line to which the worker may be secured.

19. The mounting device of claim 18 wherein the connecting means cooperates with the safety line to limit movement of the lever relative to the first elongated member when the safety line is secured to the mounting device so as to lock the mounting device against the container.

* * * * *